US006691677B2

(12) United States Patent
Eckerle et al.

(10) Patent No.: US 6,691,677 B2
(45) Date of Patent: Feb. 17, 2004

(54) FUEL DELIVERY DEVICE AND FUEL DELIVERY SYSTEM

(75) Inventors: Wayne A. Eckerle, Columbus, IN (US); Ron H. Temple, Columbus, IN (US); Lester L. Peters, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 10/076,102

(22) Filed: Feb. 15, 2002

(65) Prior Publication Data

US 2003/0154956 A1 Aug. 21, 2003

(51) Int. Cl.[7] ..... F02M 39/00

(52) U.S. Cl. ..... 123/357; 123/494; 123/41.31

(58) Field of Search ..... 123/357, 446, 123/494, 41.31, 456, 499, 436, 497; 239/88–96

(56) References Cited

U.S. PATENT DOCUMENTS

| | | | | |
|---|---|---|---|---|
| 4,462,368 A | | 7/1984 | Funada | |
| 4,463,729 A | | 8/1984 | Bullis et al. | |
| 4,520,784 A | | 6/1985 | Isobe et al. | |
| 4,532,893 A | * | 8/1985 | Day et al. | 123/41.31 |
| 4,543,914 A | * | 10/1985 | Harris | 123/41.31 |
| 4,763,611 A | * | 8/1988 | Kobayashi et al. | 123/41.31 |
| 4,811,709 A | * | 3/1989 | Braun et al. | 123/357 |
| 4,841,936 A | | 6/1989 | Takahashi | |
| 4,919,102 A | * | 4/1990 | Iwabuchi | 123/499 |
| 5,150,690 A | * | 9/1992 | Carter et al. | 123/527 |
| 5,265,576 A | * | 11/1993 | McMahon et al. | 123/458 |
| 5,287,839 A | | 2/1994 | Kondou et al. | |
| 5,370,095 A | * | 12/1994 | Yamaguchi et al. | 123/446 |
| 5,477,834 A | | 12/1995 | Yoshizu | |
| 5,819,704 A | | 10/1998 | Tarr et al. | |
| 5,839,420 A | | 11/1998 | Thomas | |
| 5,848,581 A | | 12/1998 | Hirose et al. | |
| 5,860,597 A | | 1/1999 | Tarr | |
| 6,047,682 A | | 4/2000 | Fujino et al. | |
| 6,102,009 A | | 8/2000 | Nishiyama | |
| 6,131,540 A | * | 10/2000 | Bronkal | 123/41.31 |
| 6,357,420 B1 | | 3/2002 | Matta | |
| RE37,807 E | | 7/2002 | Shinogle et al. | |

* cited by examiner

*Primary Examiner*—Carl S. Miller
(74) *Attorney, Agent, or Firm*—Nixon Peabody LLP; Tim L. Brackett, Jr.

(57) ABSTRACT

A fuel delivery device for a fuel delivery system incorporates an electronic compensation device that either incorporates information that is relevant to the specific fuel delivery device or includes a processor that generates an actuator control signal that is based at least in part upon the information contained in the memory device.

18 Claims, 2 Drawing Sheets

FUEL DELIVERY DEVICE AND FUEL DELIVERY SYSTEM

BACKGROUND OF THE INVENTION

1. Field of the Invention

This invention relates to fuel delivery devices and fuel delivery systems and, more particularly, to a fuel device incorporating an electronic compensation device that enables the fuel delivery device to process incoming fuel delivery commands in accordance with information that is specific to the fuel delivery device or to store the information that is specific to the fuel delivery device.

2. Description of Related Art

Internal combustion engine designers have increasingly come to realize that substantially improved fuel supply systems are required in order to meet the ever increasing governmental and regulatory requirements of emissions abatement and increased fuel economy. In most fuel supply systems applicable to internal combustion engines, fuel injectors are used to direct fuel pulses into the engine combustion chamber. In general, internal combustion engines having injection devices are well known. With such engines, the precise amount of fuel being injected is crucial in the control of the fuel injection system. However, injection control characteristics of the fuel injection systems inevitably suffer from the deformation and wearing out of parts in addition to changes in the physical characteristics of the fuel.

Specifically, conventional fuel injectors and fuel delivery systems experience problems due to variations in, and between, the individual injectors. In particular, each fuel injector is unique in that each injector will be at least slightly different from any other fuel injector due to inevitable variations in part-to-part manufacturing tolerances of hydromechanical components. Additionally, each of these fuel delivery devices deliver an amount of fuel that is dependent upon environmental variations such as temperature. The amount of fuel being delivered may also vary because of sensor variations in the fuel system. Moreover, fuel delivery devices change their fuel delivery characteristics during operation as they wear.

One conventional fuel system manufacturer provides injectors that have been labeled with bar codes which incorporate manufacturing information. When the fuel injectors are installed, the fuel system controller reads the bar codes and stores the manufacturing information for each injector. In this manner, the fuel system controller receives specific manufacturing information for each individual fuel delivery device when a device is first installed. However, this information is not updated on a real time basis and the system is not able to react in real time to environmental changes at the fuel delivery device.

A fuel delivery system is needed which is relatively insensitive to environmental and sensor variations, while simultaneously reducing manufacturing tolerance requirements.

SUMMARY OF THE INVENTION

It is an object of the invention, therefore, to overcome the disadvantages of the prior art and to provide a fuel delivery system which is relatively insensitive to environmental and sensor variations, while simultaneously reducing manufacturing tolerance requirements.

It is another object of the invention is to provide a fuel delivery device which includes an electronic compensation device capable of adapting commands received from a fuel system controller to the specific characteristics of the fuel delivery device.

It is yet another object of the invention to provide a fuel delivery device which includes an electronic compensation device that includes information regarding the particular fuel delivery device. For example, the information may include test data, such as control curves, actuator delays, drain flow, injector cup flow, control orifice flows and the like; manufacturing data, such as orifice sizes, spring installed heights, spring loads and the like.

It is still another object of the invention to provide a fuel delivery device which includes both an electronic compensation device and a dedicated sensor that provides feedback to the electronic compensation device. For example, the sensor may incorporate a lift sensor that generates a lift signal based upon the position of the needle valve. The lift signal would be communicated to the electronic device which would then adjust the fuel delivery commands from the fuel system controller to provide the desired lift performance or would store the lift signal. The sensor may also be adapted to detect environmental information such as injector and fuel temperature, start of injection, end of injection, common rail pressure, accumulated hours, number of injection cycles and the like.

These and other objects of the invention are achieved by providing a fluid delivery device that includes a fluid delivery valve, an actuator that opens and closes the fluid delivery valve and an electronic device.

BRIEF DESCRIPTION OF THE DRAWINGS

Exemplary embodiments of this invention will be described in detail, with reference to the following figures, wherein.

These and other features and advantages of this invention are described in or are apparent from the following detailed description of exemplary embodiments.

DETAILED DESCRIPTION OF EXEMPLARY EMBODIMENTS

Figure 1:
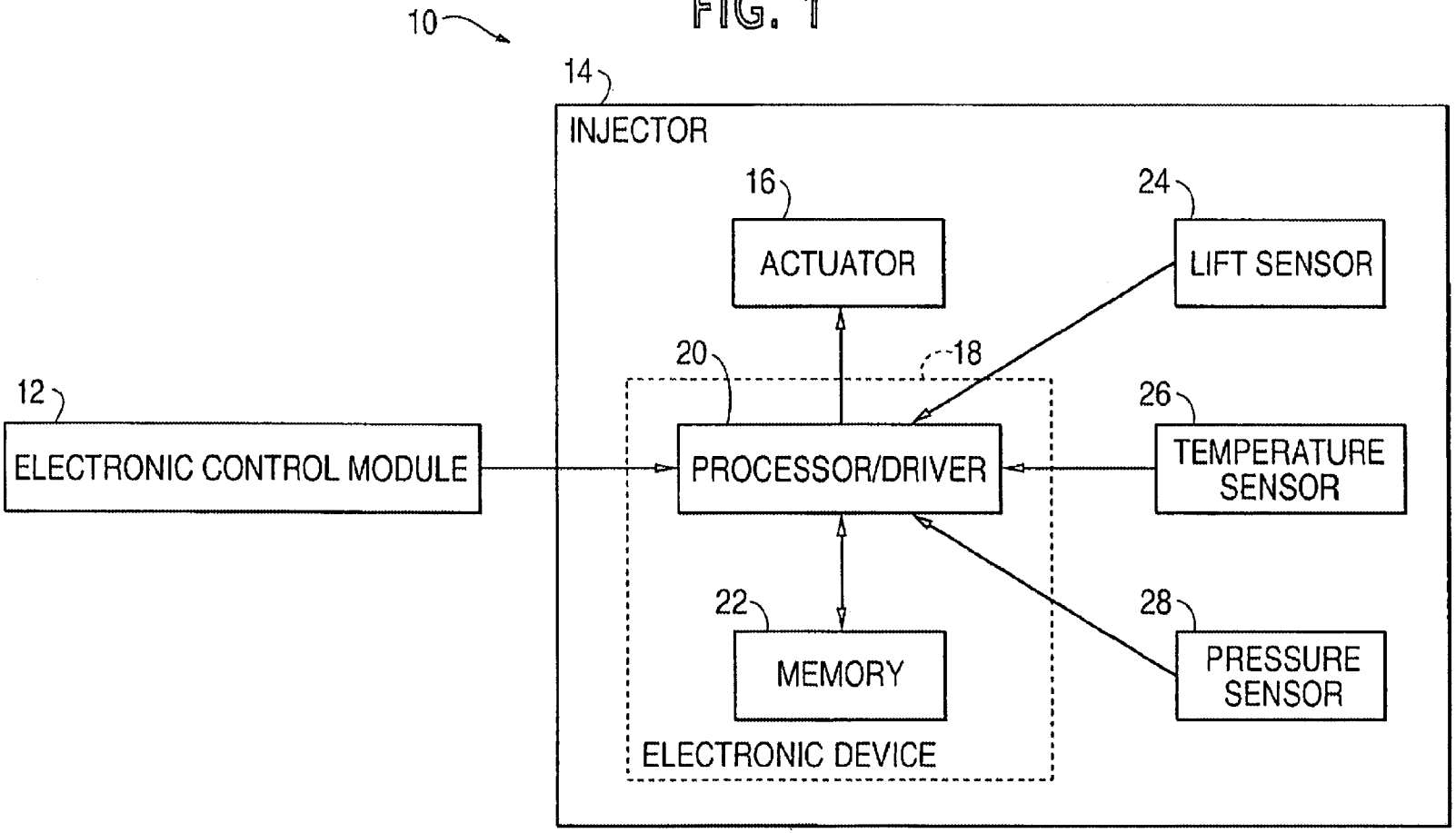
FIG. 1 is a schematic diagram of a first exemplary embodiment of a fuel delivery system in accordance with the invention.

FIG. 1 shows a schematic diagram of a first exemplary embodiment of a fuel delivery system in accordance with the invention. The fuel delivery system 10 includes an electronic control module 12 (ECM) and a fuel delivery device 14, e.g., a fuel injector, electrically connected to ECM 12. As described hereinbelow, ECM 12 provides various signals, depending on the embodiment described below, to injector 14 to ultimately effect a fuel injection event during which pressurized fuel is injected into the combustion chamber (not shown) of an internal combustion engine. The device and system of the present invention effectively controls fuel injection timing, metering, and rate shaping while compensating for variations affecting injection such as manufacturing tolerances, environmental conditions, deterioration and sensor variation.

The injector 14 has an injector body that houses an actuator 16 that controls the movement of a needle valve to control the amount of fuel, an electronic compensation device 18 that includes a processor/driver 20 in communication with the electronic control module 12 and which provides control signals to the actuator 16, a memory device 22, and several sensors such as a lift sensor 24, a temperature sensor 26, and a pressure sensor 28. Optionally, the sensors may be positioned elsewhere, outside of the injector body.

Also, fuel injector 14 may be any type of fuel injection device having an electronically controlled actuator, e.g., a solenoid, magnetostrictive or piezoelectric type, for affecting or controlling, directly or indirectly, some or all aspects of a fuel injection event, such as fuel metering, timing and/or rate shaping. For example, fuel injector 14 may be of the needle-controlled type having an actuator controlled valve for controlling the drain of high pressure fuel from a control chamber to cause an opening and closing of the injector needle valve element thereby defining an injection event such as disclosed in U.S. Pat. Nos. 5,819,704 and 5,860,597 which are incorporated herein by reference in their entirety.

In this exemplary embodiment of the fuel delivery device 10, the electronic control module 12 provides fuel delivery commands to the processor/driver 20 of the electronic compensation device 18. Exemplary commands may include a start of injection command, an injection quantity command, a rate shape command and the like. The processor/driver 20 of the injector 14 receives the commands from the electronic control module 12 and generates actuator control signals based at least in part upon the commands from the electronic control module 12. The processor/driver 20 also generates the actuator command signals based at least in part upon the information contained in memory device 22.

The memory device 22 may include various information including: test data, such as control curves, actuator delays, drain flow characteristics, injector cup flow characteristics, control orifice flows and the like; and manufacturing data such as orifice sizes, spring installed heights, spring loads and the like. The memory device 22 may also include historical sensed data to provide trend information regarding the environment being sensed by at least one of the lift sensor 24, the fuel temperature sensor 26, the fuel pressure sensor 28 and any other sensor housed by the injector body 14. In the above regard, the memory device may be implemented using any known memory technologies including magnetic, optical, ROM, steady state flash memory, smart chip technologies, or any other appropriate technologies. Moreover, the information may be stored in any appropriate manner, for example, in a database, look up tables, etc.

The fuel injector 14 is able to provide an accurate start of injection, injected quantity and rate shape as commanded by the electronic control module 12 by considering the information contained in the memory device 22, any signals received from any one of the lift sensor 24, the temperature sensor 26 and the pressure sensor 28. The fuel injector 14 is able to provide the response that is desired in accordance with the command received from the electronic control module 12 regardless of characteristics of other injectors, environmental variations, sensor variations and deterioration/wear that occurs during operation.

Figure 2:
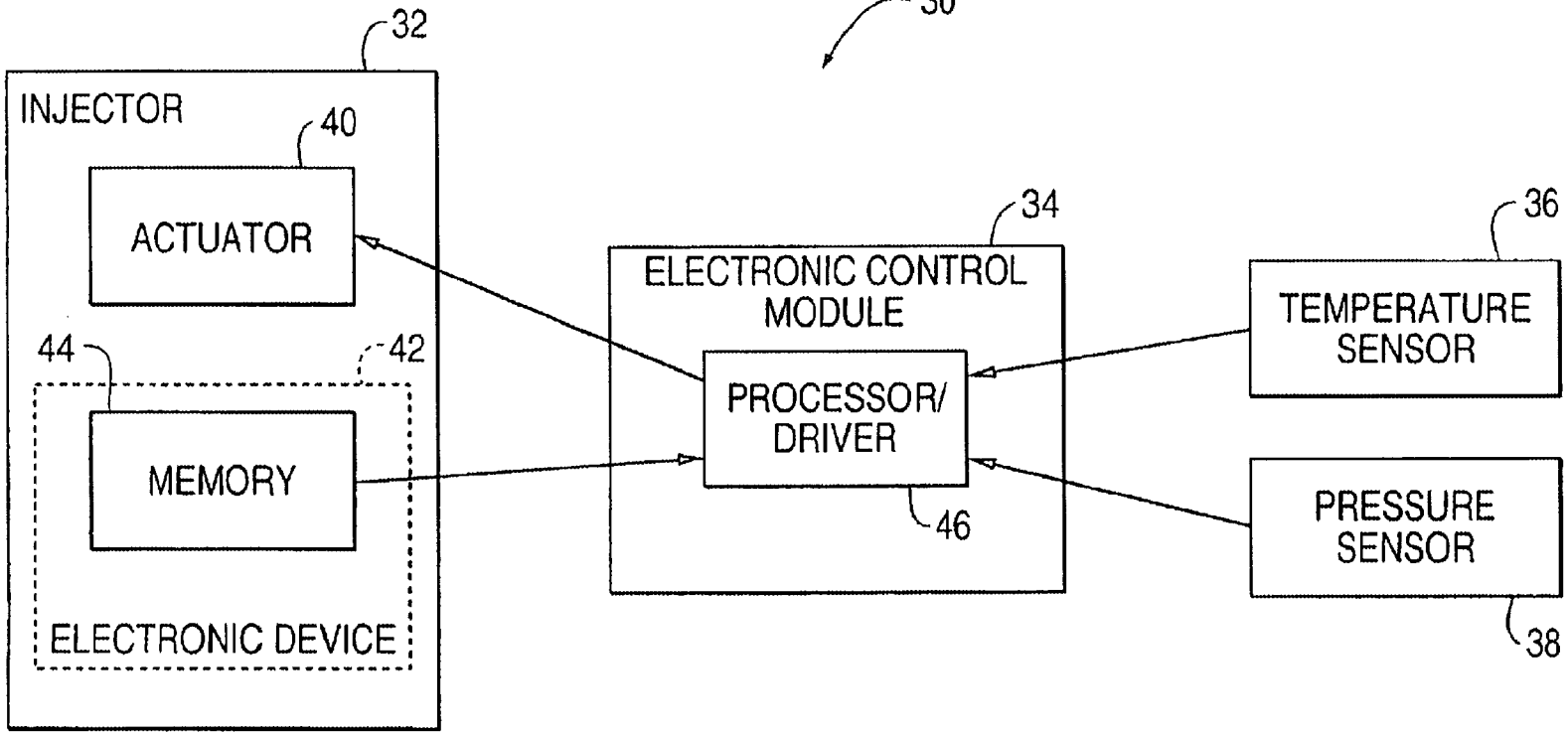
FIG. 2 is a schematic diagram of a second exemplary embodiment of a fuel delivery system in accordance with the invention.

FIG. 2 shows a second exemplary embodiment of a fuel delivery system 30 in accordance with the invention. The fuel delivery system 30 includes an injector 32, an electronic control module 34, a temperature sensor 36 and a pressure sensor 38. The injector has an injector body 32 that houses an actuator 40 and an electronic compensation device 42 that includes an injector memory device 44. The electronic control module 34 includes a processor/driver 46. In contrast with the fuel delivery system 10 of FIG. 1, the temperature sensor 36 and the pressure sensor 38 may be placed somewhere within the fuel delivery system 30 other than at the injector 32. The injector 32 still includes the actuator 40 and an electronic device 42, however, the processor/driver 46 is located at the electronic control module 34 not at the electronic compensation device 42.

The second exemplary fuel delivery system 30 responds in substantially the same manner as the fuel delivery system 10 of FIG. 1 with the exception of the electronic control module 34 includes the processor/driver 46 which is in communication with the injector memory device 44 in the electronic compensation device 42 to receive data relevant to the characteristics that are specific to the operation of the injector 32 and/or a given fuel injection event. The processor/driver 46 is also in communication with the actuator 40 to provide actuator control signals. The actuator control signals are based at least in part upon the information received from the injector memory device 44 in the electronic compensation device 42. As explained above, the injector memory device 44 may include test data and the manufacturing data that is specific to the injector 32. Additionally, the temperature sensor 36 and pressure sensor 38 may be positioned somewhere within the fuel delivery system 30 other than at the injector 34 and electronic control module 32. For example, the temperature sensor 36 and pressure sensor 38 may be placed at a common rail of a fuel delivery system. Alternatively, the injector 32 may include any type of sensor that is capable of environmental information such as a temperature sensor, a pressure sensor and the like.

It should be understood that the test data may include any type of information regarding the fuel delivery device, such as what may be obtained during performance evaluation tests of the specific fuel delivery device. Additionally, it is to be understood that the manufacturing data may also include any information regarding the design characteristics of the specific fuel delivery device. The sensors incorporated at the fuel delivery device need only be capable of measuring some status of the fuel delivery device such as the position of the needle valve, as in a lift sensor, whether the fuel delivery is open or closed, the temperature of the injector, the temperature of the fuel, a counter that determines the accumulated number of injection cycles, a timer that determines the accumulated number of hours in operation, a sensor that measures the quantity of injected fuel, and the environment into which the fuel device delivers fuel. In other words, any sensor may be used to measure the status of the environment or the status of the injector as long as it is related to the individual fuel delivery device.

It is to be understood that while the above described delivery devices and systems are all described as being fuel delivery systems, that the invention is also useful as delivery device for any type of fluid.

While this invention has been described in conjunction with the specific embodiments outlined above, it is evident that many alternatives, modifications and variations are apparent to those skilled in the art. Accordingly, the embodiment of the invention as set forth above is intended to be illustrative and not limiting. Various changes may be made without departing from the spirit and scope of the invention.

What is claimed is:

1. A fuel injection device comprising:

a fuel injection device body;

an actuator mounted on said fuel injection device body to control the fuel flow through said fuel injection device body; and an electronic compensation device mounted on said fuel injection device body to provide control signals to said actuator, wherein the electronic compensation device includes a processor in communication with the actuator.

2. The fuel injection device of claim 1, wherein the processor is responsive to a fuel delivery command to generate an actuator control signal.

3. The fuel injection device of claim 1, wherein the electronic compensation device further includes an electronic memory device that includes information related to the fuel injection device.

4. The fuel injection device of claim 3, wherein the information includes test data regarding the fuel injection device.

5. The fuel injection device of claim 4, wherein the test data includes information regarding one of control curves, actuator delays, drain flow, injector cup flow and control orifice flow.

6. The fuel injection device of claim 3, wherein the information includes manufacturing data.

7. The fuel injection device of claim 6, wherein the manufacturing data includes information regarding one of orifice sizes, spring installed heights and spring load.

8. The fuel injection device of claim 1, further comprising a sensor.

9. The fuel injection device of claim 8, wherein the sensor comprises one of an injector temperature sensor, a fuel temperature sensor, a lift sensor, a start of injection sensor, an end of injection sensor, a fuel pressure sensor and a counter.

10. A fuel injection system comprising:

an electronic control module; and a fuel injection device including:

a fuel injection device body;

an actuator mounted on said fuel injection device body to control the fuel flow through said fuel injection device body; and an electronic compensation device mounted on said injection device body to provide control signals to said actuator, said electronic compensation device including a processor in communication with the actuator and the electronic control module.

11. The fuel injection system of claim 10, wherein the electronic compensation device further includes an electronic memory device that includes information related to the fuel injection device.

12. The fuel injection system of claim 10, wherein the processor is responsive to a fuel delivery command from the electronic control module to generate an actuator control signal.

13. The fuel injection system of claim 11, wherein the information includes test data regarding the fuel injection device.

14. The fuel injection system of claim 13, wherein the test data includes information regarding one of control curves, actuator delays, drain flow, injector cup flow and control orifice flow.

15. The fuel injection system of claim 11, wherein the information includes manufacturing data.

16. The fuel injection system of claim 15, wherein the manufacturing data includes information regarding one of orifice sizes, spring installed heights and spring load.

17. The fuel injection system of claim 10, wherein the fluid injection device further includes a sensor.

18. The fuel injection system of claim 17, wherein the sensor comprises one of an injector temperature sensor, a fuel temperature sensor, a lift sensor, a start of injection sensor, an end of injection sensor, a fuel pressure sensor and a counter.

* * * * *